US006724153B2

(12) United States Patent
See et al.

(10) Patent No.: US 6,724,153 B2
(45) Date of Patent: Apr. 20, 2004

(54) APPARATUS FOR PROTECTION OF AN INDUCTIVE OUTPUT TUBE (IOT) FROM STORED ENERGY IN A LINEAR HIGH VOLTAGE POWER SUPPLY (HVPS) AND ITS ASSOCIATED FILTER CIRCUIT DURING A HIGH VOLTAGE ARC

(75) Inventors: Alvin B. See, Westfield, MA (US); Fred M. Stefanik, Feeding Hills, MA (US)

(73) Assignee: Thales Broadcast & Multimedia, Inc., Southwick, MA (US)

( * ) Notice: Subject to any disclaimer, the term of this patent is extended or adjusted under 35 U.S.C. 154(b) by 0 days.

(21) Appl. No.: 10/076,327

(22) Filed: Feb. 19, 2002

(65) Prior Publication Data

US 2003/0155868 A1 Aug. 21, 2003

(51) Int. Cl.[7] ..... H05B 37/02

(52) U.S. Cl. ..... 315/209 R; 315/225; 315/291

(58) Field of Search ..... 315/224, 225, 315/307, 308, 291, 219, 244, 209 R, DIG. 4

(56) References Cited

U.S. PATENT DOCUMENTS

| | | | | | |
|---|---|---|---|---|---|
| 5,140,229 | A | * | 8/1992 | Yagi et al. | 315/307 |
| 5,739,643 | A | * | 4/1998 | Usui | 315/308 |
| 5,903,110 | A | * | 5/1999 | Pol et al. | 315/307 |
| 5,910,709 | A | * | 6/1999 | Stevanovic et al. | 315/225 |
| 6,194,842 | B1 | * | 2/2001 | Canova | 315/225 |
| 6,452,343 | B2 | * | 9/2002 | Oostvogels et al. | 315/209 R |

* cited by examiner

*Primary Examiner*—Wilson Lee
(74) *Attorney, Agent, or Firm*—Oblon, Spivak, McClelland, Maier & Neustadt, P.C.

(57) ABSTRACT

Control and filter circuits for linear power supplies, employing resistance to limit the release of stored energy and simultaneously removing the input mains AC, so as to protect a load device from damage when a high voltage fault occurs. The circuits may be used particularly in output filters for high voltage power supplies for high power transmitting tubes, such as Inductive Output Tubes used in UHF television transmitters, which must be protected from internal arcing by a controlled release of stored energy and a rapid disconnection of input power. The use of the filter circuit combined with rapid solid state switching ensures that the load is not subject to an excessive surge when a high voltage fault occurs.

36 Claims, 11 Drawing Sheets

APPARATUS FOR PROTECTION OF AN INDUCTIVE OUTPUT TUBE (IOT) FROM STORED ENERGY IN A LINEAR HIGH VOLTAGE POWER SUPPLY (HVPS) AND ITS ASSOCIATED FILTER CIRCUIT DURING A HIGH VOLTAGE ARC

BACKGROUND OF THE INVENTION

1. Field of the Invention

The present invention relates to a linear High Voltage Power Supply (HVPS) and its filters for high power RF transmitting tubes, such as Inductive Output Tubes (IOTs) that may be employed in a cost effective amplifier suitable for use, for example, in a digital television transmitter for the broadcast industry, or in any other appropriate application for such an amplifier.

2. Discussion of the Background

In Broadcast Television, transmitters for UHF frequencies typically require much higher RF power (energy) than VHF transmitters. Typically, tubes employed in UHF transmitters have outputs of 20–30 kW. For UHF transmitters, the Inductive Output Tube (IOT) is usually the device best suited for high power amplification. The IOT is, however, easily damaged internally from high voltage arcs that can occur inside the vacuum envelope of the tube. The damage is primarily caused by the release of stored energy from the filter circuit of the High Voltage Power Supply (HVPS). The output of the HVPS may be 20–40 kV, at 2–3 A, so the stored energy can be considerable. Also contributing significantly is the power that is still available from the input AC power to the HVPS until the AC mains can be interrupted after an arc starts. Traditional IOT amplifiers utilize electromechanical contactors to connect and interrupt the input AC power. These contactors can take between 30 and 50 milliseconds to interrupt the AC.

When the very first IOT amplifier devices in UHF television transmitters became commercially available in 1988 to replace klystrons, one significant difference between these tubes and the older klystron technology was the requirement for fast removal of the high voltage, in the event of an arc within the vacuum envelope of the tube, to limit the release of stored energy enough to prevent any permanent internal damage to the IOT. For example, for IOTs commonly available from Marconi Applied Technologies, it is specified that this energy should not exceed 20 Joules. For analog television broadcasting, considerable stored energy in the power supply filter, especially in capacitors, was required to handle the signal to noise requirements and the long periodic duration, dynamic load changes of the analog signal on the high voltage power supply.

The common method to use in accomplishing this fast removal of high voltage was to use a crowbar circuit incorporating a triggered spark gap or a hydrogen thyratron, which protects the IOT by shunting the energy of the power supply. As technology has progressed, there have been instances where the use of a switching power supply, with low inherent stored energy coupled with a high speed switching regulator circuit, could provide proper IOT internal arc protection. Both the crowbar and the switching power supply are viable, industry standard solutions, but come with an associated cost and complexity.

The most economical and reliable HVPS is the linear type, which consists of a transformer, a full-wave rectifier and a filter, utilizing the AC power line frequency. Because of the low frequency, filter components have high values and consequentially can store large amounts of energy. To accomplish fast removal of high voltage, transmitter manufacturers have utilized crowbar circuits incorporating devices such as triggered spark gaps and hydrogen thyratrons to shunt the energy of the power supply around the IOT, as already mentioned. The operation of the crowbar circuit can cause very high current surges both in the high voltage power supply (HVPS) as well as in the AC line voltages supplying the transmitter. The high AC current surges can cause excessive wear and/or burning of the switch contacts in the contactors and circuit breakers that feed the power supply and can cause glitches or transients on the AC power lines that can effect other equipment operating nearby.

A medium to high frequency switching regulator type power supply, because of its higher frequency and the nature of the electronics that drive the "switching", can provide an HVPS with low stored energy and a fast switch-off of the input power, thus eliminating the requirement for a shunt type crowbar system.

Both the shunt type crowbar and the switching type HVPS add complexity and reliability issues to the amplifier, as well as additional costs.

Prior to the present invention, the state of the art has generally been considered to be that either a switching type HVPS was required to eliminate the need for a crowbar circuit, or that if a linear HVPS was used, then a crowbar circuit had also to be used.

The above assumptions made in the prior art were based upon accommodating the needs of an analog television transmission system. The broadcast industry is transitioning from analog to digital, and the digital (DTV) transmitters have a lower Signal-to-Noise Ratio (SNR) requirement. The DTV signal also presents a different characteristic for the dynamic load change to the HVPS.

The generally accepted standard for measuring the potentially damaging, stored energy an IOT can be subjected to by the HVPS system is the "wire test." This test is described as putting a specified length and size of fine wire between the power supply and the load, then causing a short circuit around the load and seeing if the wire is damaged or burned up before the high voltage is removed from the load. For example, a wire test published by Marconi Applied Technologies requires that 300 mm length of 36 AWG wire shall not fail when tested as described above. Thales Electron Devices, on the other hand, specify that the enamel should not be damaged on 375 mm length of 34 AWG wire. Other manufacturers of IOTs have published their own specific variation of a wire test; details of these are readily available in the particular data sheets or user guides.

The traditional filter shown in FIG. 1 was designed to have an amplitude of hum, ripple and noise to be at least 60 dB below the level of the high voltage. This filter has no added series resistance to the inductor, and thus has no current limiting effects until the AC mains are interrupted (follow-on or follow-through current.) The capacitor in this filter is typically 8 $\mu$F for analog service, whereas for DTV, the capacitance can be much less. With an appropriate resistance in series with an appropriately sized capacitor, energy from the capacitor can be adequately limited, but the follow-through and stored energy in the inductor is not addressed.

In FIG. 1, a filter circuit that is typical of the conventional art is shown. Input power is delivered from an AC source 11, typically 480 v three-phase, via a switch 10 to a transformer and rectifier block 1. An inductor 3 is in series with the output of the transformer and rectifier block 1 and the input of a load device 2. A capacitor 4 (having a typical value of 8 microfarads) usually has a resistor 5 (having a typical value of 60 Ohms) arranged in series therewith to provide charge current limiting, and ripple current limiting for the capacitor 4. The resistor 5 also limits the current from the capacitor 4, but not the inductor 3, during a short circuit or high voltage arc event. Such an event is detected by excess current in current transformer 8 operating a crowbar 9 to shunt the HVPS output and open the switch 10.

SUMMARY OF THE INVENTION

One aspect of the present invention is to address and resolve the above-identified and other limitations of background art devices.

This invention is particularly, but not exclusively applicable to digital television transmitters and CW (continuous wave) or pulsed RF amplifiers where a signal to noise ratio requirement is not as stringent as in an analog television transmitter. In such applications, this system design can leverage the less stringent filtering requirements of the HVPS, to develop a transmitter amplifier system that exploits the lower cost of the linear HVPS and eliminates the cost and complexity of either a shunt crowbar or a switching power supply. A solid state type switch for the AC mains is used for its faster turn off time, even though it adds some additional cost and complexity. A solid-state switch using an SCR device can interrupt the AC supply to the transformer in approximately 9 milliseconds when excessive load current is detected. This type of device is required to appropriately limit the follow-on current. Other more exotic solid state switching devices and circuits that operate even faster are alternatives as well.

This invention addresses the stored energy in the HVPS as well as the speed at which the AC line is opened up (follow-on current) to eliminate the need for the crowbar circuit. The filter in the HVPS is important to the performance of the transmitter and therefore cannot be discarded. The invention includes a filter that maintains the performance of the transmitter while reducing the stored energy and/or limiting the discharge rate of the stored energy thereby creating a system that not only will meet the requirements of the wire test but will also protect an IOT from damage caused by an arc within the vacuum envelope.

This invention provides a solution to the problems discussed in the background art by way of a system that utilizes a "standard" type linear high voltage power supply, a solid state, electronic primary switch to facilitate the removal of the input AC mains power faster than the typical electromechanical contactor, and an output filter on the power supply that has a low enough stored energy, but sufficient filtering for the DTV (digital television) signal. The DTV signal provides a benefit for this application in that it has a lower signal to noise (SNR) ripple requirement from the HVPS and experiences much shorter duration, dynamic load changes than analog television. A filtered linear HVPS according to the present invention is arranged in such a manner as to properly provide power to an IOT used in DTV service while fully protecting the IOT from potential harm due to high voltage arcs, without the use of either a protective shunt crowbar system, or a medium to high frequency switching regulator type power supply. The filter meets DTV performance requirements and protects an IOT in a manner that meets the IOT manufacturer's "wire test" requirements.

Moreover, a feature of the invention is to take the protection requirements imposed by the manufacturers of the IOTs and the SNR requirement of the amplifier system to develop a filter system for a linear HVPS that results in an IOT amplifier that uses a linear HVPS without a crowbar circuit.

BRIEF DESCRIPTION OF DRAWINGS

Referring now to the drawings, wherein like reference numerals refer to identical or corresponding parts.

DETAILED DESCRIPTION OF THE PREFERRED EMBODIMENTS

Figure 3:
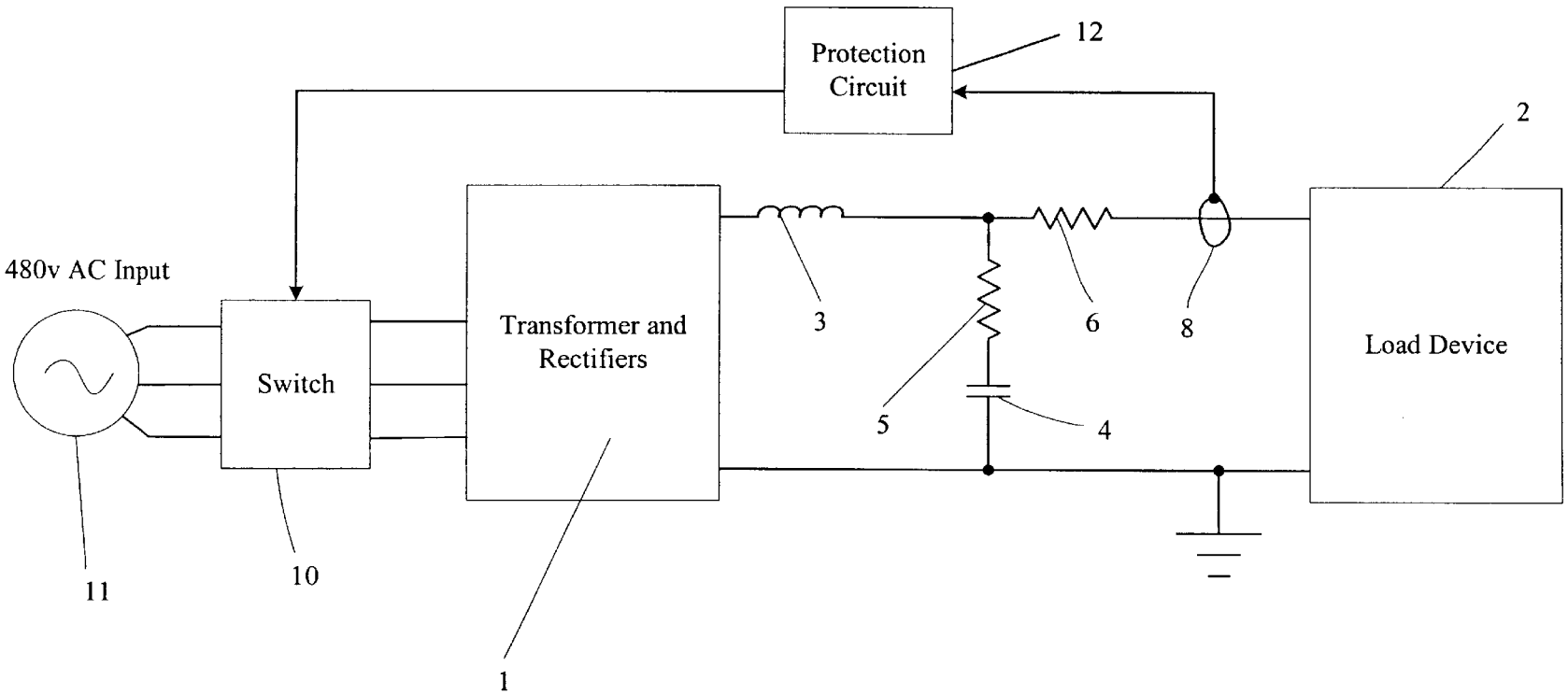
FIG. 3 is a schematic diagram of a filter circuit according to a further embodiment of the invention.
Figure 4:
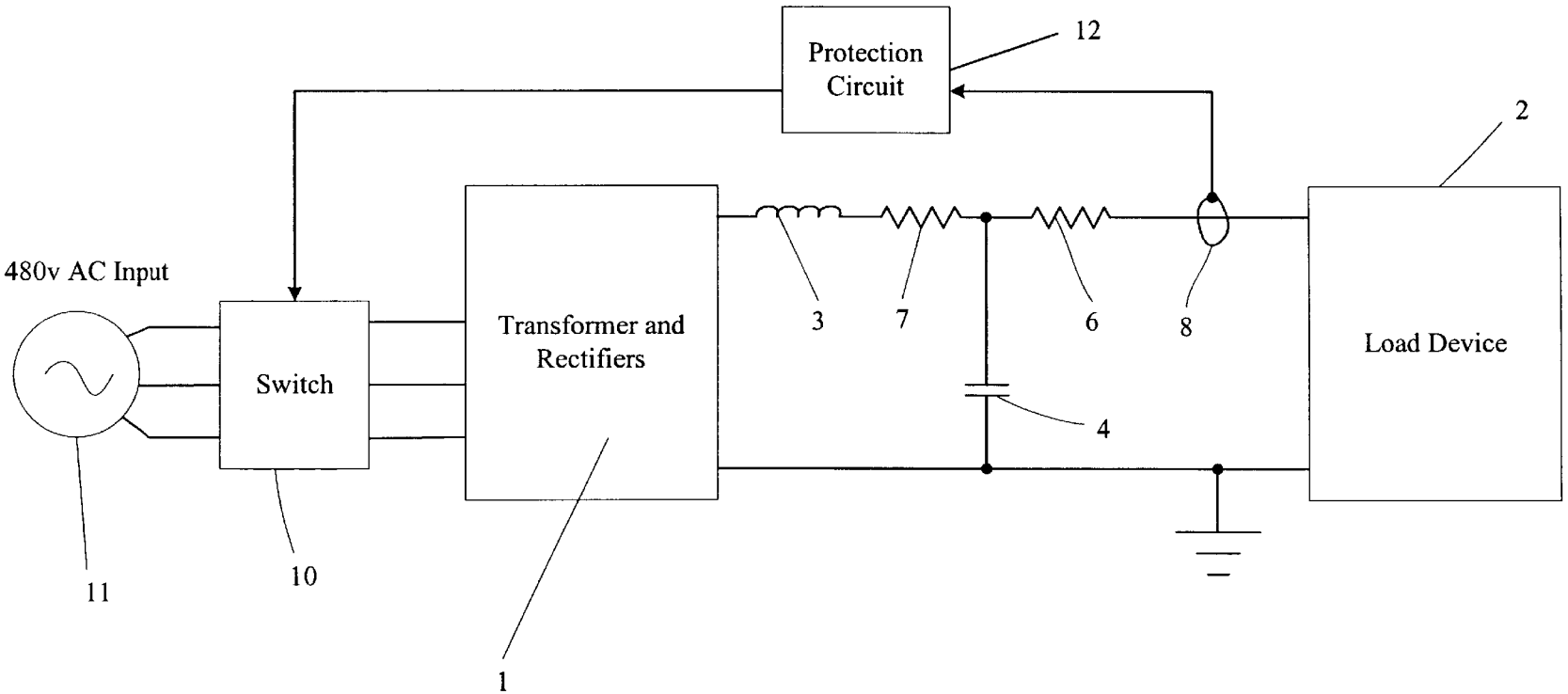
FIG. 4 is a schematic diagram of a filter circuit according to a third embodiment of the invention.
Figure 5:
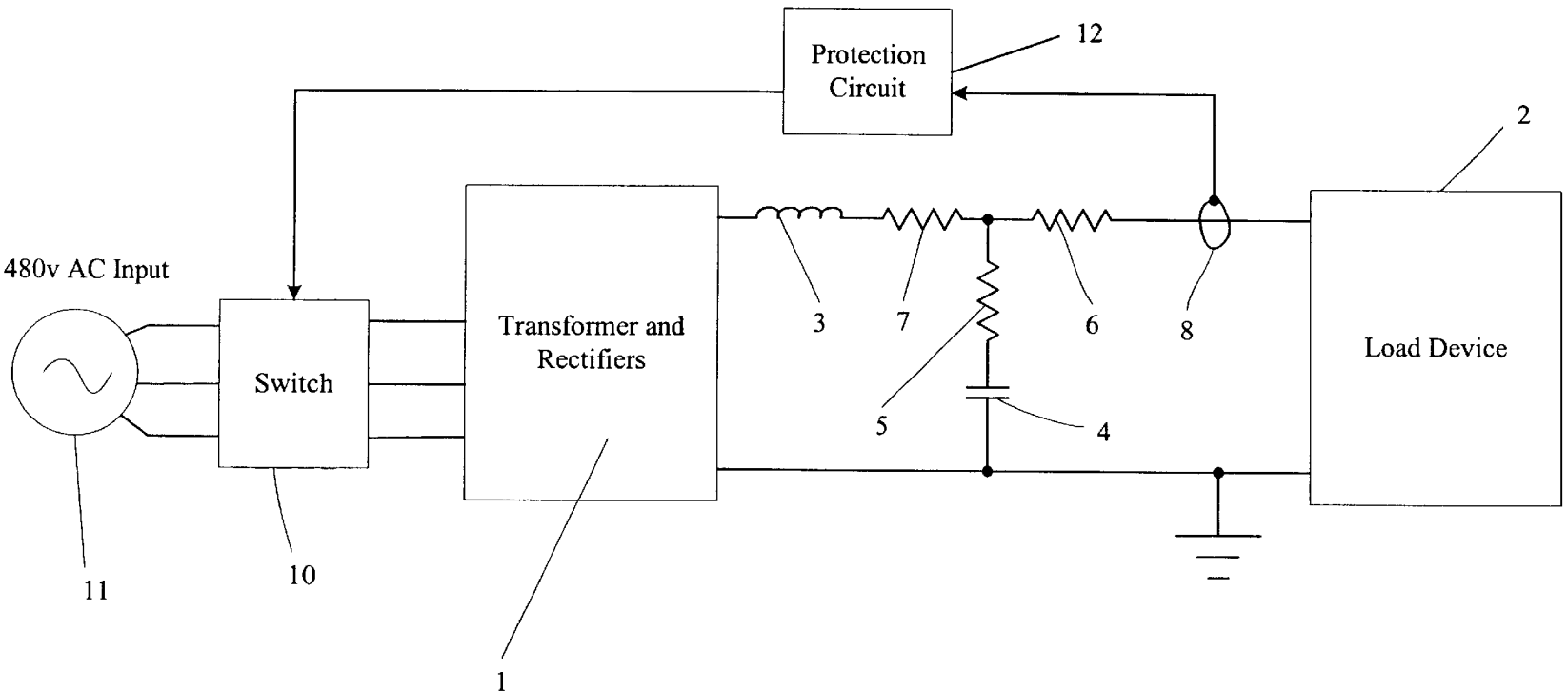
FIG. 5 is a schematic diagram of a filter circuit according to a fourth embodiment of the invention.

FIGS. 2, 3, 4, 5 and 6 show various embodiments of filter configuration, according to the invention. Each includes an L-C (inductor and capacitor) filter section, but each embodiment involves employing resistance elements in different positions in the filter. The embodiment of FIG. 2 has the fewest components, but the embodiment of FIG. 5 represents the preferred embodiment for the filter. However, the other embodiments may also be adjusted to employ suitable component values to allow proper operation and protection of the IOT. It will be appreciated by persons skilled in the HVPS art that more than one L-C filter section may be used, that 'T' or 'pi' filter sections may be used, and that balanced filter sections may be used without departing from the scope of the invention. It will further be appreciated by persons skilled in the art that the invention may be applied to power supplies having multiple outputs of different voltages, such as may be used with multi-stage depressed collector (MSDC) devices.

An additional factor in the selection of filter component values is the impedance of the transformer. Lower transformer impedance usually gives better voltage regulation between low load and full load, but also allows more current to flow into a fault such as a high voltage arc. This impedance will need to be appropriately adjusted in the design of the power supply system.

Throughout the figures, the block labeled "Transformer and Rectifiers" (TR) 1 may include a three phase transformer utilizing 480 volts on its primary terminals, and with an appropriate turns ratio to yield the needed DC voltage (usually −36 kilovolts) for the IOT. Transformers for this application are usually connected with a Delta configuration for the primary windings and a Wye (Star) configuration for the secondary windings, which in turn feed a full wave rectifier. Other voltages and configurations may also be used without departing from the scope of the invention.

Throughout the figures, the load 2 is labeled "IOT and Support Systems", and includes the various sub-systems that normally make up a High Power Amplifier (HPA). These include but are not limited to a heater power supply, a grid bias power supply, a focus power supply, cooling systems, etc.

When an excessive current to the load is detected by current transformer 8 and protection circuit 12, switch 10 is opened to interrupt the AC power to the transformer and rectifier block 1.

Figure 1:
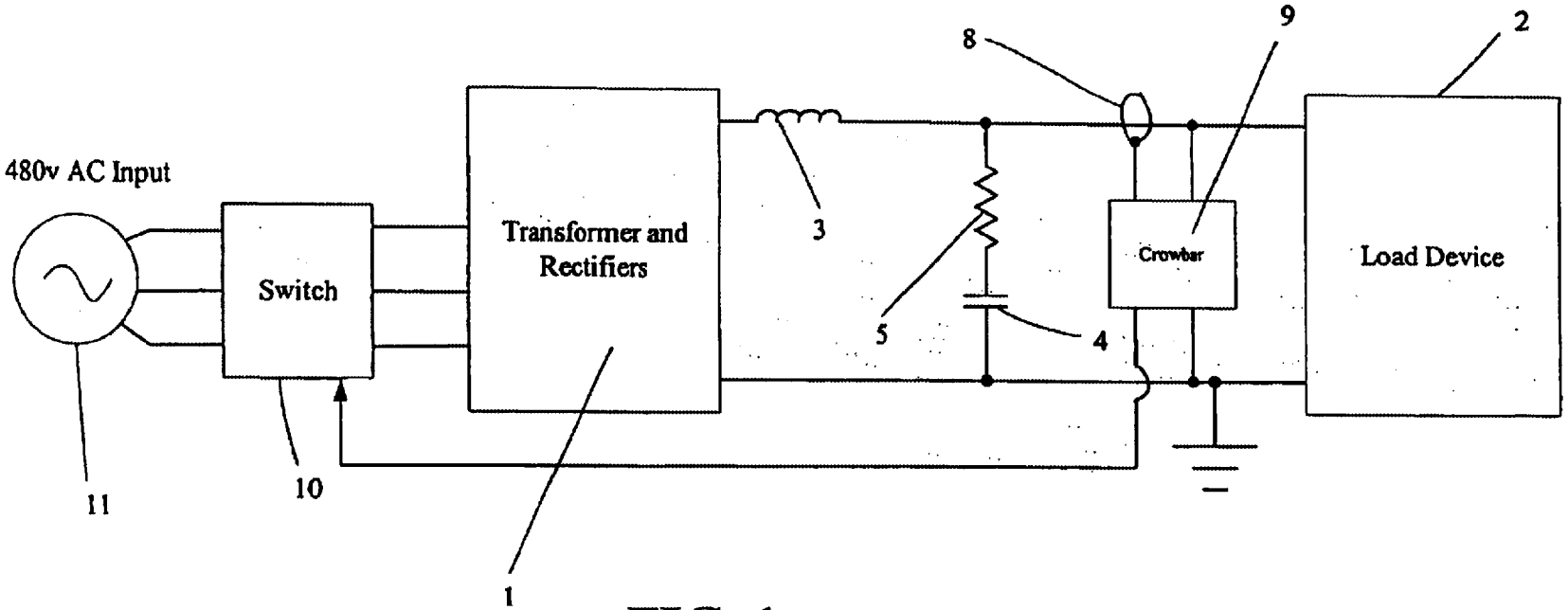
FIG. 1 PRIOR ART
FIG. 1 is a schematic diagram of a filter circuit that is typical of a conventional configuration.
Figure 2:
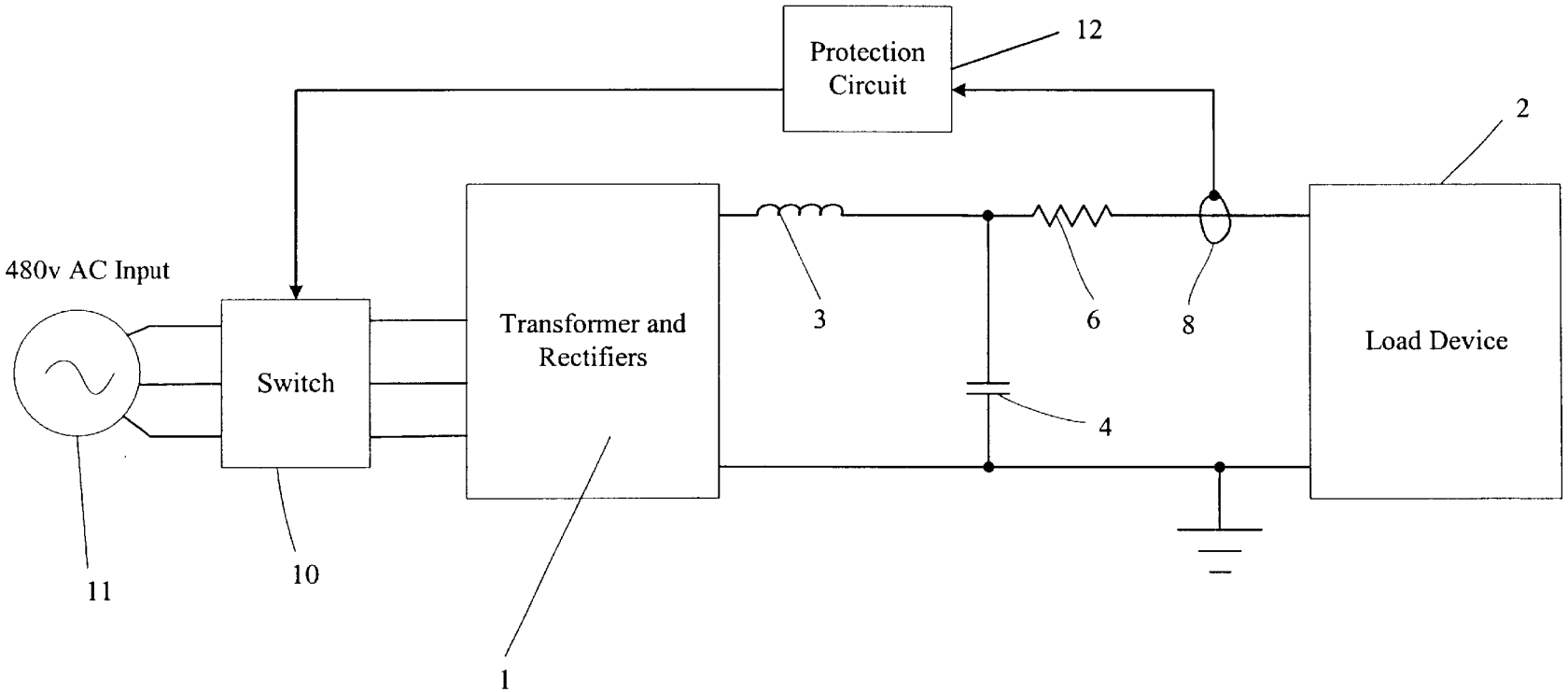
FIG. 2 is a schematic diagram of a filter circuit according to one embodiment of the invention.

In FIG. 2, a resistor 6, preferably having a value less than 500 Ω, is used to provide short circuit current limiting for both the capacitor 4 and the inductor 3. During a fault, the energy stored in the electric field associated with capacitor 4 and in the magnetic field associated with inductor 3 is discharged through resistor 6 and to ground through the load 2 when switch 10 is opened by protection circuit 12 and remaining energy is dissipated. Limiting the fault current by way of resistor 6 limits the rate at which this energy is transferred to the load 2, thereby protecting the load 2 from damage. However, depending on the value of the capacitor 4, the ripple current as seen by this capacitor may still be high, causing this capacitor to potentially overheat.

In FIG. 3, the resistor 5 is employed, in series with the capacitor 4, to limit ripple current while keeping the resistor 6 positioned as shown in FIG. 2. The resistor 5, typically having a value of around 60 Ω, limits the fault current from the capacitor, but not the inductor, during a short circuit or high voltage arc event, as before. Therefore, in the embodiment of FIG. 3, not only the current due to stored energy in the inductor 3 and the capacitor 4 is limited, but the ripple current is also limited, providing further protection.

In FIG. 4, a resistor 7, preferably having a value of less than 500 Ω, is employed in series with the inductor 3. The resistor 7 in this position limits the ripple current to the capacitor 4, but it also limits the fault current from the inductor 3, but not the capacitor 4, during a short circuit or high voltage arc event.

The resistor 5 as shown in FIG. 3 and the resistor 7 as in FIG. 4 also limit the charging current to the capacitor 4 during turn on, which presents the further advantage of limiting over-voltage transients at turn-on.

In FIG. 5, three resistors 5, 6 and 7 are employed to combine the advantages of both FIGS. 3 and 4.

Figure 6:
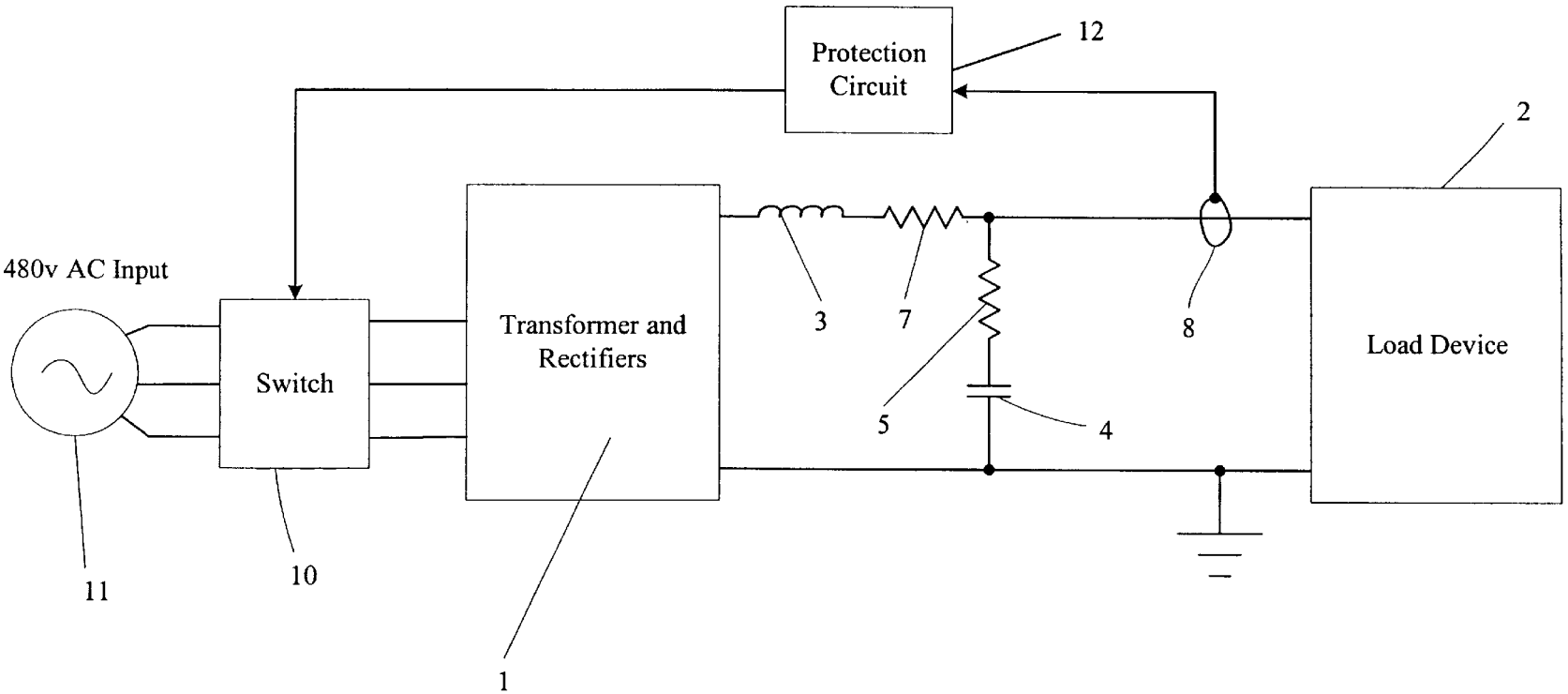
FIG. 6 is a schematic diagram of a filter circuit according to a fifth embodiment of the invention.

FIG. 6 shows a variation of FIG. 5 that reduces the number of resistors needed by employing only resistor 7 and resistor 5.

To summarize the advantages of adding these various resistors, resistor 7, as in the embodiments of FIGS. 4, 5, and 6, limits the ripple current and limits the current from the inductor 3, as well as limiting turn-on transients. Adding resistor 6, on the other hand, as in the embodiments of FIGS. 2, 3, 4 and 5, limits the current from both the capacitor 4 and the inductor 3. Each of the embodiments disclosed limits the current due to stored energy in both the capacitor 4 and the inductor 3.

FIGS. 7–11 show further embodiments of the invention employing only capacitors and resistors, but no inductors, in the filter circuit. Substantially the same advantages are obtained in these embodiments as in the embodiments of FIGS. 2–6, respectively.

Figure 7:
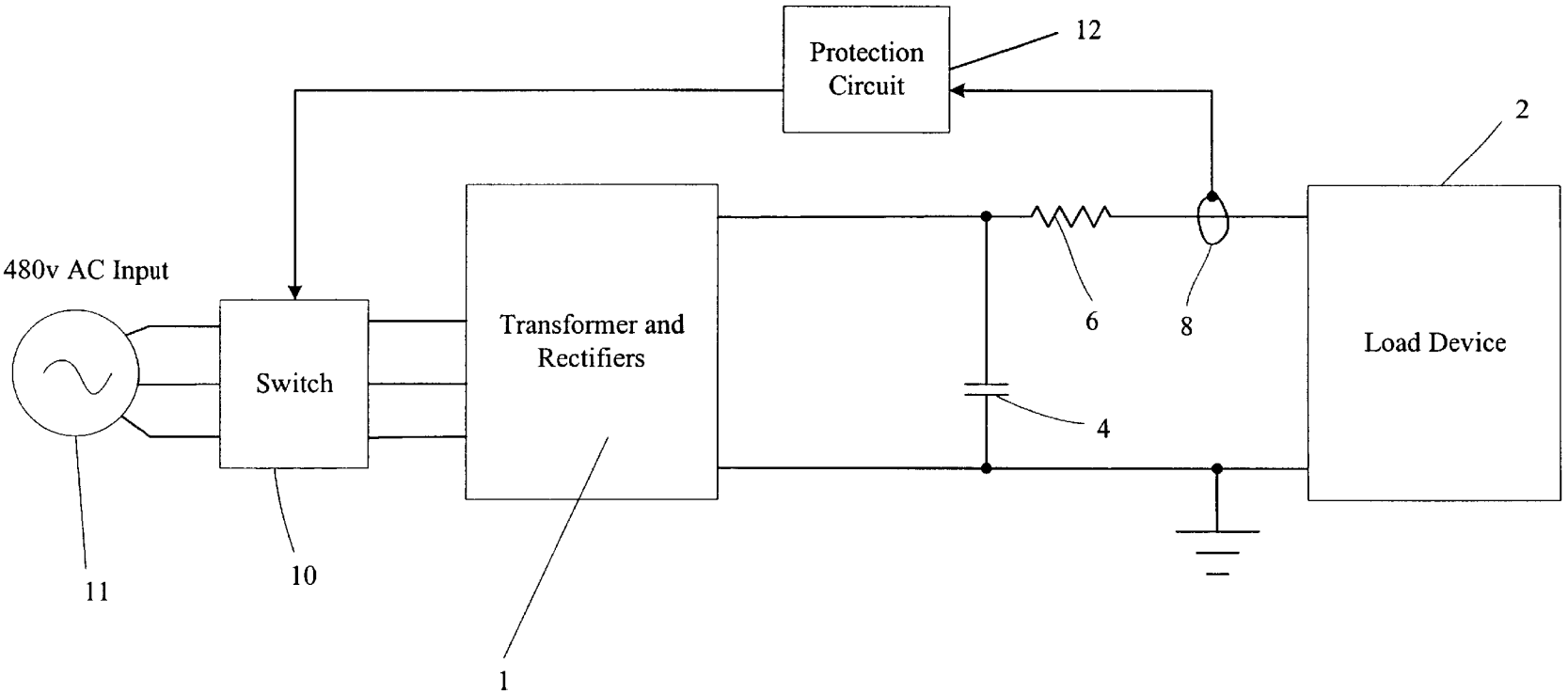
FIG. 7 is a schematic diagram of a filter circuit according to a sixth embodiment of the invention.

In FIG. 7, a resistor 6, preferably having a value less than 500 Ω, is used to provide short circuit current limiting for the capacitor 4. During a fault, the energy stored in the electric field associated with capacitor 4 is discharged through resistor 6 and to ground through the load 2 when switch 10 is opened by protection circuit 12 and remaining energy is dissipated. Limiting the fault current by way of resistor 6 limits the rate at which this energy is transferred to the load 2, thereby protecting the load 2 from damage.

Figure 8:
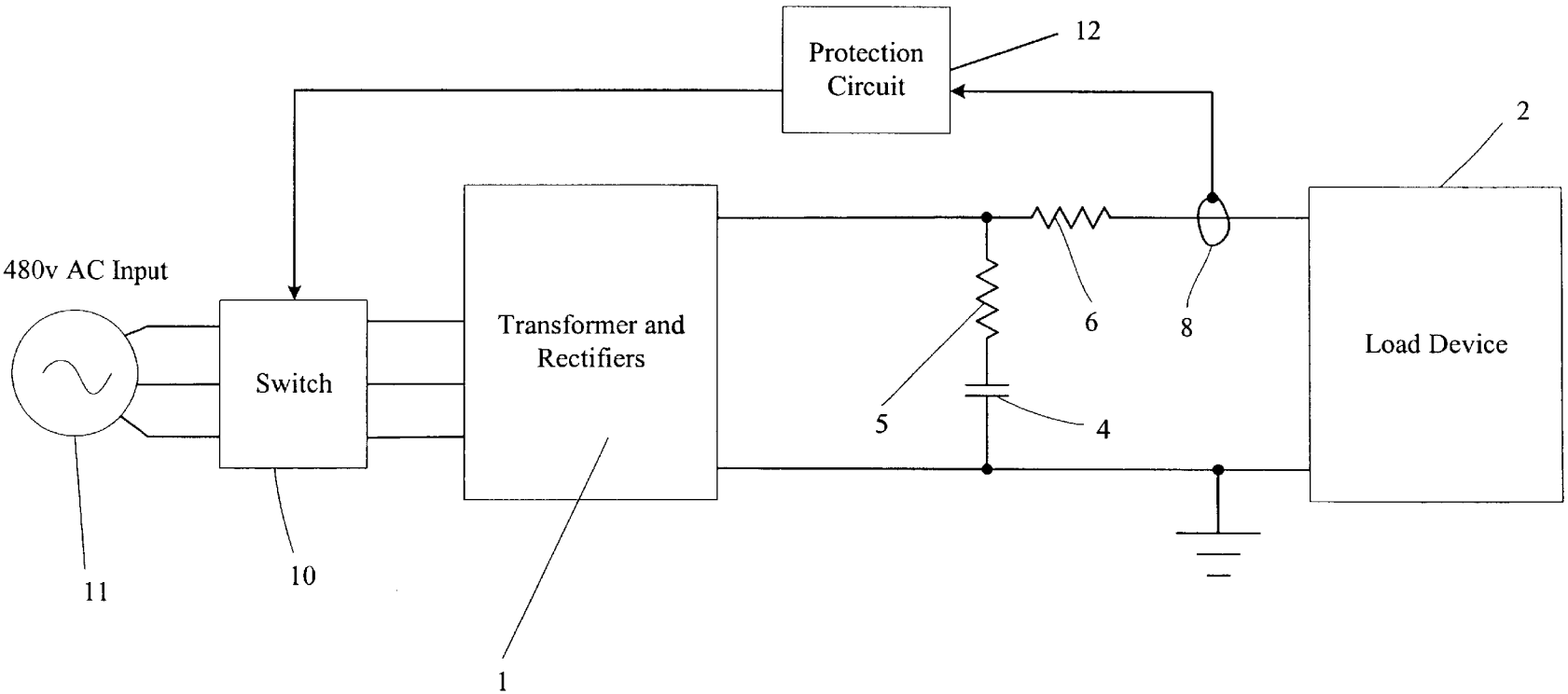
FIG. 8 is a schematic diagram of a filter circuit according to a seventh embodiment of the invention.

In FIG. 8, the resistor 5 is employed, in series with the capacitor 4, to limit ripple current while keeping the resistor 6 positioned as shown in FIG. 7. The resistor 5, typically having a value of around 60 Ω, limits the fault current from the capacitor during a short circuit or high voltage arc event, as before. Therefore, in the embodiment of FIG. 8, not only the current due to stored energy in the capacitor 4 is limited, but the ripple current is also limited, providing further protection.

Figure 9:
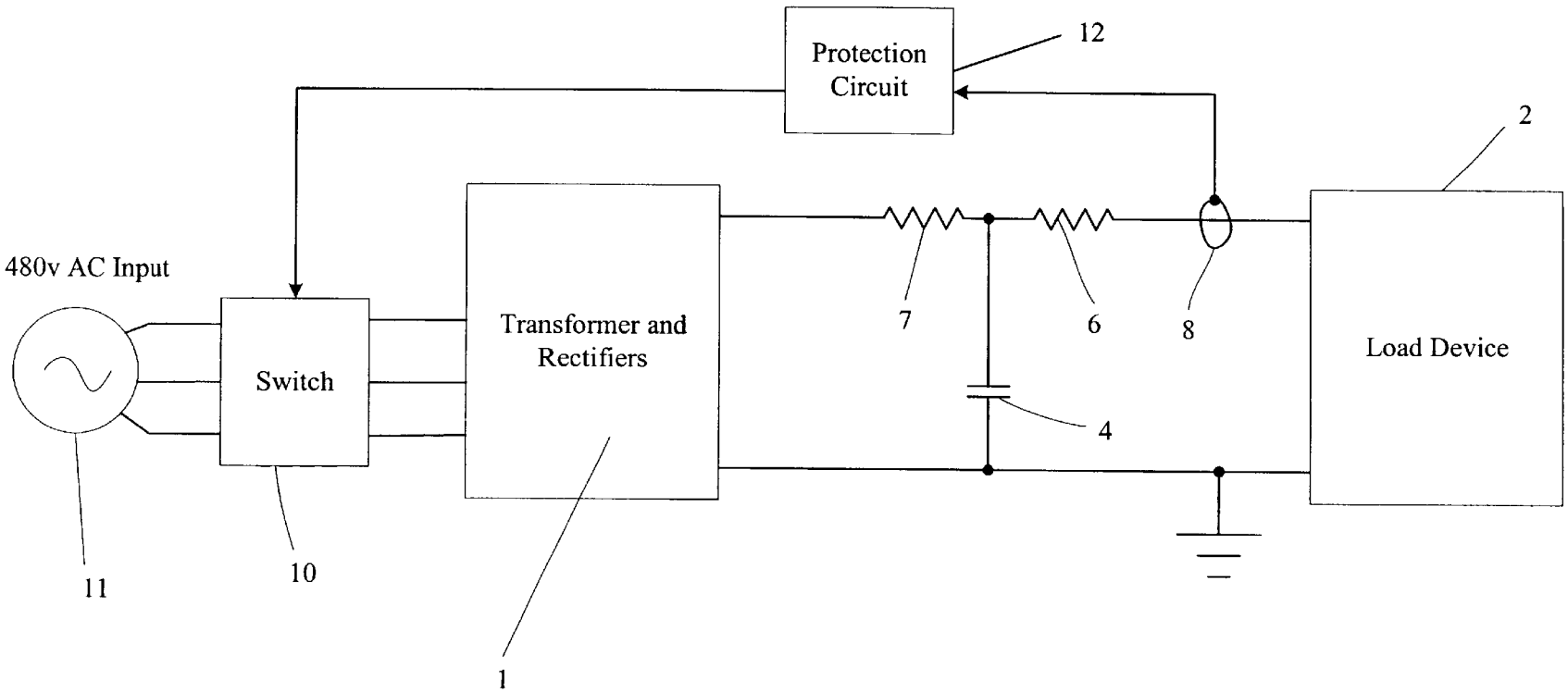
FIG. 9 is a schematic diagram of a filter circuit according to an eighth embodiment of the invention.

In FIG. 9, a resistor 7, preferably having a value of less than 500 Ω, is employed in series with the transformer and rectifier block 1 and the load 2, between the transformer and rectifier block 1 and the capacitor 4. The resistor 7 in this position limits the ripple current to the capacitor 4 during a short circuit or high voltage arc event.

The resistor 5 as shown in FIG. 8 and the resistor 7 as in FIG. 9 also limit the charging current to the capacitor 4 during turn on, which presents the further advantage of limiting over-voltage transients at turn-on.

Figure 10:
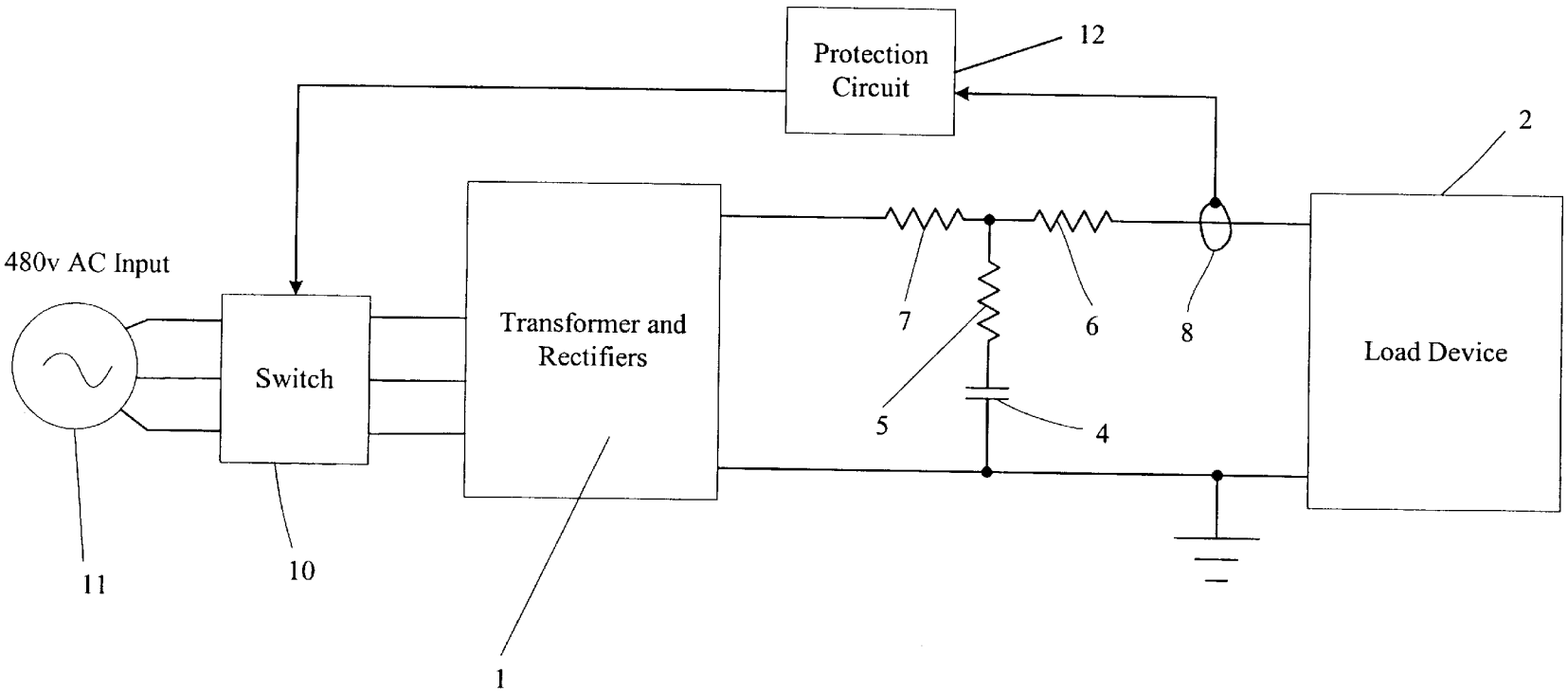
FIG. 10 is a schematic diagram of a filter circuit according to a ninth embodiment of the invention.

In FIG. 10, three resistors 5, 6 and 7 are employed to combine the advantages of both FIGS. 8 and 9.

Figure 11:
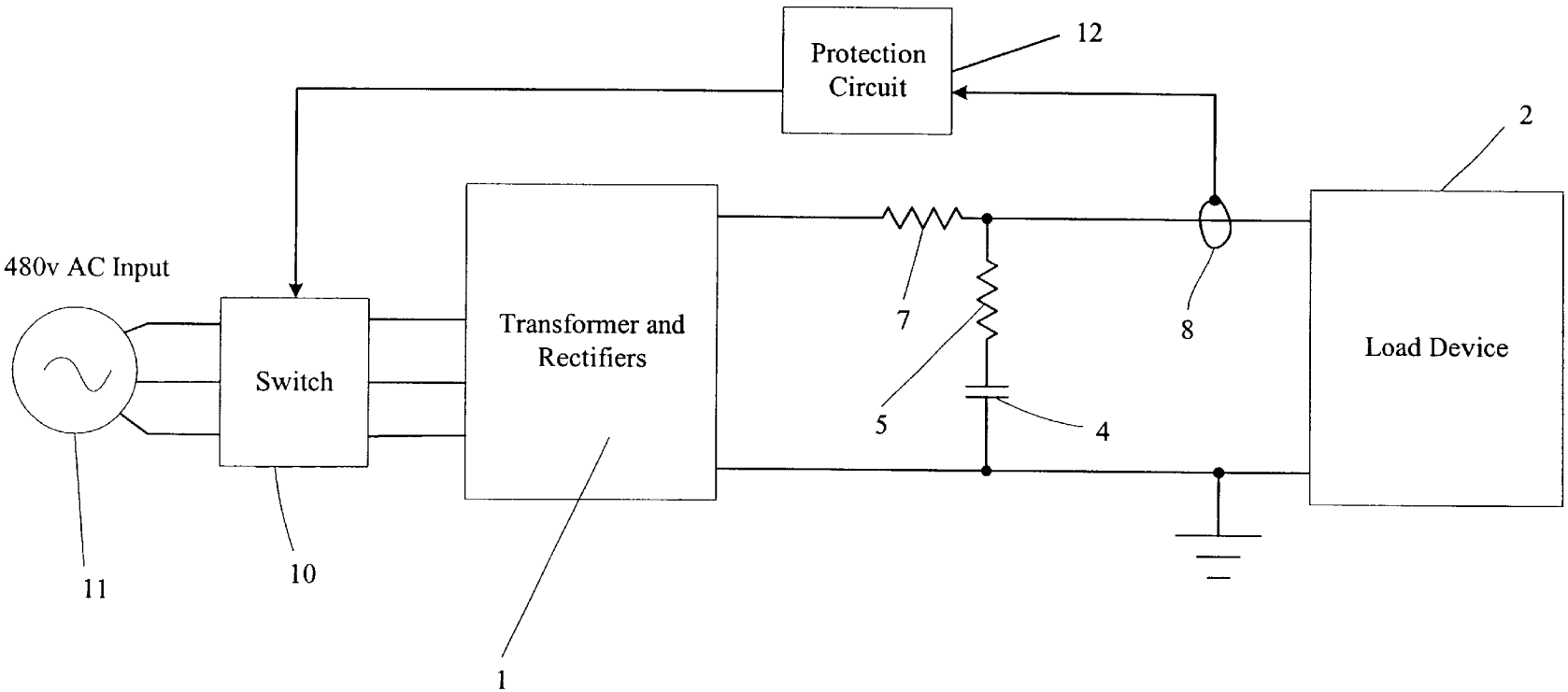
FIG. 11 is a schematic diagram of a filter circuit according to a tenth embodiment of the invention.

FIG. 11 shows a variation of FIG. 10 that reduces the number of resistors needed by employing only resistor 7 and resistor 5.

To summarize the advantages of the embodiments of FIGS. 7–11, resistor 7, as in the embodiments of FIGS. 9, 10, and 11, limits the ripple current as well as limiting turn-on transients. Adding resistor 6, on the other hand, as in the embodiments of FIGS. 7, 8, 9 and 10, limits the current from both the capacitor 4. Each of the embodiments of FIGS. 7–11 limits the current due to stored energy in the capacitor 4, and from the transformer and rectifiers 1.

Obviously, numerous modifications and variations of the present invention are possible in light of the above teachings. It is therefore to be understood that, within the scope of the appended claims, the invention may be practiced otherwise than as specifically described herein.

What we claim is:

1. A filter circuit for a linear high voltage power supply configured to provide power to a high power transmitting tube while protecting the tube during a high voltage arc event, said filter circuit comprising:

an inductor having a first terminal connected to a first terminal of a rectifier of said linear high voltage power supply and having a second terminal;

a capacitor having a first terminal coupled to said second terminal of said inductor, and having a second terminal coupled to a second terminal of said rectifier; and a resistance element comprising a resistor having one terminal coupled to at least one of said inductor and capacitor and having another terminal coupled to said high power transmitting tube, wherein said resistance element is further configured to limit current from at least one of said inductor or capacitor to said high power transmitting tube during the high voltage arc event or other fault condition.

2. The filter circuit according to claim 1, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

3. The filter circuit according to claim 2, wherein said high power transmitting tube employs Inductive Output Tube technology.

4. The filter circuit according to claim 1, wherein said resistance element further comprises another resistor configured to limit stored energy in said inductor from being discharged.

5. The filter circuit according to claim 4, further comprising a third resistor configured to limit stored energy in said inductor from being discharged.

6. The filter circuit according to claim 5, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

7. The filter circuit according to claim 6, wherein said high power transmitting tube employs Inductive Output Tube technology.

8. The filter circuit according to claim 4, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

9. The filter circuit according to claim 8, wherein said high power transmitting tube employs Inductive Output Tube technology.

10. The filter circuit according to claim 1, wherein said resistance element further comprises another resistor connected between said capacitor and said high power transmitting tube.

11. The filter circuit according to claim 10, further comprising a third resistor connected with said capacitor and connected to said second terminal of said inductor.

12. The filter circuit according to claim 11, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

13. The filter circuit according to claim 12, wherein said high power transmitting tube employs Inductive Output Tube technology.

14. The filter circuit according to claim 10, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

15. The filter circuit according to claim 14, wherein said high power transmitting tube employs Inductive Output Tube technology.

16. The filter circuit according to claim 1, wherein said resistor is connected with said capacitor and is connected to said second terminal of said inductor.

17. The filter circuit according to claim 16, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

18. The filter circuit according to claim 17, wherein said high power transmitting tube employs Inductive Output Tube technology.

19. A filter circuit for a linear high voltage power supply configured to provide power to a high power transmitting tube while protecting the tube during a high voltage arc event, said filter circuit comprising:

a capacitor having a first terminal coupled to a first terminal of a rectifier of said linear high voltage power supply, and having a second terminal coupled to a second terminal of said rectifier; and a resistance element comprising a resistor having one terminal coupled to said capacitor and having another terminal coupled to said high power transmitting tube, but said filter circuit not comprising an inductor coupled to either of said capacitor or said resistance element, and wherein said resistance element is further configured to limit current from said capacitor to said high power transmitting tube during the high voltage are event or other fault condition.

20. The filter circuit according to claim 19, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

21. The filter circuit according to claim 20, wherein said high power transmitting tube employs Inductive Output Tube technology.

22. The filter circuit according to claim 19, wherein said resistance element further comprises another resistor connected between said first terminal of said rectifier and said capacitor.

23. The filter circuit according to claim 22, further comprising a third resistor connected wit said capacitor and connected to said second terminal of said rectifier.

24. The filter circuit according to claim 23, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

25. The filter circuit according to claim 24, wherein said high power transmitting tube employs Inductive Output Tube technology.

26. The filter circuit according to claim 22, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

27. The filter circuit according to claim 26, wherein said high power transmitting tube employs Inductive Output Tube technology.

28. The filter circuit according to claim 19, wherein said resistance element further comprises another resistor coupled to said capacitor and connected to said high power transmitting tube.

29. The filter circuit according to claim 28, further comprising a third resistor connected with said capacitor and coupled to said second terminal of said rectifier.

30. The filter circuit according to claim 29, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

31. The filter circuit according to claim 30, wherein said high power transmitting tube employs Inductive Output Tube technology.

32. The filter circuit according to claim 28, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

33. The filter circuit according to claim 32, wherein said high power transmitting tube employs Inductive Output Tube technology.

34. The filter circuit according to claim 19, wherein said resistor is connected with said capacitor and is connected to said second terminal of said rectifier.

35. The filter circuit according to claim 34, wherein a quantity of energy stored in said filter circuit is sufficiently small, a rate of release of said energy is sufficiently limited, and an input voltage is disconnected from said power supply sufficiently rapidly, so as to prevent damage to said high power transmitting tube during the high voltage arc event or other fault condition.

36. The filter circuit according to claim 35, wherein said high power transmitting tube employs Inductive Output Tube technology.

* * * * *